US010716735B2

(12) United States Patent
Carrel et al.

(10) Patent No.: US 10,716,735 B2
(45) Date of Patent: Jul. 21, 2020

(54) ADAPTOR FOR COUPLING WITH A MEDICAL CONTAINER

(71) Applicant: Becton Dickinson France, Le Pont de Claix (FR)

(72) Inventors: Franck Carrel, Le Pont de Claix (FR); Frédéric Perot, Saint Paul de Varces (FR); Philippe Laurent, Oullins (FR)

(73) Assignee: Becton Dickinson France, Le Pont de Claix (FR)

( * ) Notice: Subject to any disclaimer, the term of this patent is extended or adjusted under 35 U.S.C. 154(b) by 835 days.

(21) Appl. No.: 14/763,529

(22) PCT Filed: Jan. 28, 2014

(86) PCT No.: PCT/EP2014/051569
§ 371 (c)(1),
(2) Date: Jul. 27, 2015

(87) PCT Pub. No.: WO2014/114807
PCT Pub. Date: Jul. 31, 2014

(65) Prior Publication Data

US 2016/0000651 A1 Jan. 7, 2016

(30) Foreign Application Priority Data

Jan. 28, 2013 (EP) ..... 13305095

(51) Int. Cl.
*A61J 1/20* (2006.01)
*A61J 1/14* (2006.01)

(52) U.S. Cl.
CPC ..... *A61J 1/2055* (2015.05); *A61J 1/1406* (2013.01); *A61J 1/201* (2015.05); *A61J 1/2096* (2013.01)

(58) Field of Classification Search
CPC ..... A61J 1/2055; A61J 1/2096; A61J 1/201; A61J 1/1406; B65D 51/002
See application file for complete search history.

(56) References Cited

U.S. PATENT DOCUMENTS

| | | | |
|---|---|---|---|
| 4,576,211 | A | 3/1986 | Valentini et al. |
| 5,342,319 | A | 8/1994 | Watson et al. |
| 5,494,170 | A | 2/1996 | Burns |
| 2004/0199139 | A1 | 10/2004 | Fowles et al. |
| 2006/0138070 | A1 | 6/2006 | Domkowski et al. |

FOREIGN PATENT DOCUMENTS

| | | | |
|---|---|---|---|
| EP | 0541423 | A1 | 5/1993 |
| FR | 2560049 | A1 | 8/1985 |

*Primary Examiner* — Ariana Zimbouski
(74) *Attorney, Agent, or Firm* — The Webb Law Firm

(57) ABSTRACT

The invention relates to an adaptor for coupling with a medical container closed by a septum, the adaptor comprising:—a gripping member (20) for securing the adaptor to the medical container,—a needle access port intended to face an outer surface of the septum,—a pierceable elastomeric piece (50) having a longitudinal axis located into the needle access port, said pierceable elastomeric piece having a recess (51) with a proximal opening and an outer wall (54) in contact with the needle access port,—attaching means for maintaining the elastomeric piece into the needle access port. The invention also relates to an assembly comprising such an adaptor and a medical container, and to the use of such an adaptor for preventing the contamination inside a medical container closed by a septum.

7 Claims, 11 Drawing Sheets

ADAPTOR FOR COUPLING WITH A MEDICAL CONTAINER

CROSS-REFERENCE TO RELATED APPLICATIONS

This application is the United States national phase of International Application No. PCT/EP2014/051569 filed Jan. 28, 2014, and claims priority to European Patent Application No. 13305095.5 filed Jan. 28, 2013, the disclosures of which are hereby incorporated in their entirety by reference.

BACKGROUND OF THE INVENTION

Field of the Invention

The present invention relates to an adaptor for coupling with a medical container such as a vial containing a pharmaceutical product, the adaptor allowing withdrawal of multiple doses of said pharmaceutical product while maintaining its sterility and its efficacy over an extended period of time.

Description of Related Art

In this application, the distal end of a component or apparatus must be understood as meaning the end furthest from the hand of the user and the proximal end must be understood as meaning the end closest to the hand of the user, with reference to the injection device intended to be used with said component or apparatus. As such, in this application, the distal direction must be understood as the direction of injection with reference to the injection device, and the proximal direction is the opposite direction, i.e. the direction of the transfer of the product from the vial to the injection device.

Medical containers such as vials are commonly used to store and distribute drugs or vaccine intended to be injected to patients. Such containers are inexpensive, durable and can be made sterile before being filled with a pharmaceutical product. A number of doses can be stored in a limited space and they can be easily manipulated with a single hand. Such hand-held medical containers are therefore convenient for medical staff working outside of the hospital. Indeed, they are widely used in large scale immunization programs or during pandemics, where populations living in remote area, far away from towns and hospital facilities, need to be vaccinated or cured.

However, it is mandatory for the success of such programs that the pharmaceutical products stored in such vials remain effective and sterile until injection to populations. If multidose vials are usually closed by a rubber septum intended to act as a barrier between the inside of the vial and the outside environment, such septums are not efficient enough to restrict outside contaminants from reaching the pharmaceutical product over time.

First of all, such septum is intended to be pierced by the needle of an injection device to withdraw a single dose of the pharmaceutical product stored into the vial. However, the septum is usually not completely hermetic, and the hole formed after the piercing of the needle can be slow to close depending on the resealing properties of the septum, and significant amount of ambient air is usually sucked into the vial after the removal of the needle. As this piercing operation should be repeated as many times as the number of doses stored into the vial, contaminants such as bacteria, viruses, germs or dust are progressively carried into the vial, and thus into the pharmaceutical product.

Next, the outer surface of the septum may be contaminated during storage or handling of the multidose vials. Pharmaceutical products often require to be stored at low temperature, for example from 2 to 8° C., while they are handled and injected at ambient temperature, for example around 30° C. to 40° C. in tropical areas. This could lead to the formation of condensation on the surface of the outer surface of the septum, therefore producing a favorable environment for the development of bacteria. Furthermore, it may happen that multidose vials be handled in poor hygienic conditions, especially in the case of remote immunization programs where injections are realized outside of the hospitals. These outside contaminations could migrate from the outer surface of the septum to the pharmaceutical product stored into the vial because of the successive piercings required to withdraw product doses.

It is therefore difficult to guarantee the sterility and the drug potency beyond a limited period of time. For example, the current practice in tropical areas is to waste medical containers 24 hours after their first opening, regardless of the number of remaining doses. This leads to wastage of large quantities of pharmaceutical product and increases significantly the cost of immunization programs and pandemics. Moreover, there is a risk that a contaminated product be injected to a patient because of an incorrect disposal of contaminated vials. This could result in non-effective vaccination of population, significant side-effects and a loss of confidence in immunization programs.

Moreover, if the successive piercings of the septum of the multidose vials with the needle of an injection device are not realized properly, it may happen that the needle be damaged or bended. Finally, there is a risk of accidental pricking for the user, as the user's fingers are very close from the needle of the injection device during this operation and as the user needs to grasp an injection device while operating a multidose vial. This could lead to discard unused injection device and or multidose vials, thus increasing the cost of immunization programs or pandemics.

Consequently, there is a need for a device capable of maintaining the sterility and the efficacy of pharmaceutical products stored into multidose vials, over an extended period of time and despite multiple successive piercings by the needle of an injection device. This device should also be straightforward and safe to handle, even by a non-trained user.

SUMMARY OF THE INVENTION

A first aspect of the invention is an adaptor for coupling with a medical container, said medical container having a collar closed by a septum, said septum having an outer surface directed towards the outside of the medical container, the adaptor including:

- a gripping member for securing the adaptor to the medical container,
- a needle access port intended to face the outer surface of the septum when the adaptor is coupled to the medical container,
- a pierceable elastomeric piece having a longitudinal axis L, located into the needle access port of the gripping member, said pierceable elastomeric piece having a recess with a proximal opening, an outer wall in contact with the needle access port, and a distal surface comprising a protruding part intended to be engaged with the outer surface of the medical container septum, wherein the elastomeric piece and the needle access port include attaching means for maintaining the elastomeric piece into said needle access port when a pressure is applied by the protruding part on the outer surface of the septum.

The adaptor of the invention is intended to be coupled with a medical container, such as for example a conventional vial for storing pharmaceutical products, such as multidose vials for vaccines. Such a vial 1 is shown on FIGS. 1A-1C and generally comprises a tubular barrel 2 having a longitudinal axis A, closed at an end and having a collar 3 at the opposite end, said collar 3 forming an opening 3*a* closed by a septum 4. Usually, the septum 4 is fixedly attached to the collar 3 of the vial 1 by a peripheral band 5, said peripheral band 5 leaving a part of the septum 4, herein called outer surface 4*a* of the septum, directly facing the outside of the vial 1, namely the outside environment. The septum 4 is usually made of a material impermeable to gas and liquid and it seals hermetically the content of the vial 1. The septum 4 is also pierceable by the needle of an injection device intended to be filled with the product contained in the vial, said septum 4 being accessible to said needle via its outer surface 4*a*.

Alternatively, the adaptor could be used in combination with a medical container that has an opening not closed by a septum.

This adaptor allows to maintain the sterility and the efficacy of a pharmaceutical product stored into said multidose vial: the recess of the elastomeric piece allows to preserve the area intended to be pierced from any contact with contaminated surfaces or with the user's fingers. This ensures that the needles used to pierce the elastomeric piece will not carry outside contaminants to the inside of the medical container. Preferably, the ratio between the height of said recess regarding its width ranges from 0.3 to 0.7. More precisely, the ratio between the height of said recess regarding its width is about 0.6. These values have been found to be favorable in preserving a clean and uncontaminated surface to be pierced, inside the elastomeric piece.

In embodiments, the recess includes a bottom surface defining a central protrusion. In case of the formation of condensation, the protrusion allows to preserve a dry and clean portion of the bottom surface intended to be pierced by the needle of an injection device. Indeed, the formation of condensation could rapidly lead to the development of microorganisms such as bacteria that could migrate to the inside of the vial due to the repeated piercings required to withdraw doses. The central protrusion of the recess therefore contributes to reduce the potential contamination of the inside of the vial when coupled to an adaptor according to the present invention. Preferably, the ratio between the height of said central protrusion regarding the height of said recess ranges from 0.1 to 0.3 and the ratio between the width of said central protrusion regarding the width of said recess ranges from 0.3 to 0.7. More precisely, the ratio between the height of said central protrusion regarding the height of said recess is about 0.20 and the ratio between the width of said central protrusion regarding the width of said recess is between 0.6.

In embodiments, the elastomeric piece has a proximal surface sloped distally to the center of said recess. This distally sloped surface is intended to guide the needle of an injection device to the bottom of the recess of the elastomeric piece. This surface thus prevents the user to accidentally damage or bend the needle while withdrawing a dose from the multidose vial. The risk of accidental pricking is also significantly reduced. Additionally, in case of the formation of condensation, this distally sloped surface forces the condensation to migrate towards the recess of the elastomeric piece. Thus the condensation cannot flow between the elastomeric piece and the needle access port and the development of microorganism such as bacteria is avoided nearby the septum of the vial. Preferably, the slope of the proximal surface of said elastomeric piece forms an angle ranging from 45° to 75° regarding the longitudinal axis L of the elastomeric piece.

An adaptor according to the previous embodiments can be used to prevent the contamination of the inside of a medical container closed by a septum.

Another aspect of the present invention is an assembly including an adaptor coupled with a medical container, said medical container having a collar closed by a septum, said septum having an outer surface directed towards the outside of the medical container, the adaptor including:

a gripping member for securing the adaptor to the medical container, a needle access port intended to face the outer surface 4*a* of the septum when the adaptor is coupled to the medical container, a pierceable elastomeric piece with a longitudinal axis L and located into said needle access port, said pierceable elastomeric piece having a recess with a proximal opening, an outer wall in contact with the needle access port, and a distal surface comprising a protruding part intended to be engaged with the outer surface of the medical container septum, wherein the elastomeric piece and the needle access port include attaching means for maintaining the elastomeric piece into said needle access port when a pressure is applied by the protruding part on the outer surface of the septum.

This assembly allows maintenance of the efficacy and the sterility of the pharmaceutical product stored into said vial. Indeed, such assembly limits two sources of contamination. The first source of contamination is a direct contact with foreign surfaces or unclean fingers on the elastomeric piece, such contamination being able to migrate from the elastomeric piece to the inside of the vial because of the repeated piercings required to withdraw the pharmaceutical product from the vial. Such way of contamination is prevented by the presence of the recess of the pierceable elastomeric piece. The second source of contamination is the contamination brought by ambient air which could be sucked into the vial, as some vacuum is created by the withdrawal of a dose that would help the introduction of air inside the container. Such air could carry dust and microorganism directly to the pharmaceutical product. Such source of contamination is prevented by the tight contact between the distal surface of the elastomeric piece and the outer surface of the septum of the vial as the elastomeric piece closes the hole formed in the septum after the withdrawal of the needle before the septum resealed, and therefore prevents sucking of the ambient air into the vial.

The engagement of the protruding part with the outer surface of the medical container septum results from a strong contact pressure at the interface between the elastomeric piece and the septum of the vial. This further prevents any air to be sucked into the vial, in particular when the last dose of the pharmaceutical product is about to be withdrawn from a multidose vial, and acts as a further protection against contamination of the inside of the vial by the ambient air.

The attaching means or attaching arrangement may include a circular groove present on the outer wall of said elastomeric piece and at least one peg extending radially from the needle access port, said at least one peg being engaged within said groove. For example, the attaching means includes three pegs extending radially from the needle access port. These attaching means allow a simple and fast assembly of the elastomeric piece into the needle access port by pushing the elastomeric piece into the needle access port by its distal face. These attaching means may also include a shoulder defined on the outer wall of said elastomeric piece and a distal abutment surface defined in the needle access port, said shoulder resting against, said distal abutment surface. As the shoulder is on abutment on the distal abutment surface, this prevents any proximal translation of the elastomeric piece regarding the needle access port, because of the pressure resulting from the engagement of the protruding part of the elastomeric piece and the outer surface of the septum of the vial.

Another aspect of the present invention is a pierceable elastomeric piece intended to be coupled with a medical container, said pierceable elastomeric piece having a recess with a proximal opening and a bottom surface intended to be pierced by a needle.

The pierceable elastomeric piece allows the guiding of a needle of an injection device directly to the bottom surface of its recess, said bottom surface being intended to be pierced, while avoiding any damage of the needle or accidental pricking of the user. Thanks to the specific shape of recess, the bottom surface intended to be pierced is also preserved from any contamination in case of contact between the pierceable elastomeric piece and a contaminated surface of the user's fingers. This ensures that the needles used to pierce the elastomeric piece will not carry outside contaminants to the inside of the medical container and therefore preserves the sterility and the drug potency of the pharmaceutical product stored inside the medical container.

In an embodiment, the recess of the pierceable elastomeric piece is further provided with a central protrusion. Such protrusion allows keeping a portion of the bottom surface of the septum dried and cleaned even if condensation is formed. This further prevents the contamination of the needle of an injection device, during repeated piercings of the elastomeric piece.

In embodiments, the ratio between the height of said central protrusion and the height of said recess ranges from 0.1 to 0.3, preferably is around 0.2. This ensures that the surface of a user's finger cannot contact the central protrusion by accident and reduces the risk of condensation to contaminate said central protrusion.

In preferable embodiments, the ratio between the width of said central protrusion and the width of said recess ranges from 0.3 to 0.7, preferably is around 0.6. This ratio also contributes to keep the central protrusion dry and clean, said central protrusion being the portion of the bottom surface of the recess intended to be pierced by the needle of an injection device.

In embodiments, the ratio between the height of said central protrusion and the height of said recess ranges from 0.1 to 0.3, preferably is about 0.2 and the ratio between the width of said central protrusion and the width of said recess ranges from 0.3 to 0.7, preferably is about 0.6.

Another aspect of the invention is to use a pierceable elastomeric piece according to the previous embodiments to prevent the contamination of the inside of a medical container closed by a septum. This can be done by coupling the pierceable elastomeric piece on the top of said medical container, and in particular on the top of the septum of the medical container. The pierceable elastomeric piece may further include part of attaching means for maintaining the elastomeric piece into tight contact with the septum of the medical container.

In accordance with a further embodiment of the invention, an adaptor for coupling with a medical container is disclosed. The medical container has a collar closed by a septum, with the septum having an outer surface directed towards the outside of the medical container. The adaptor includes a gripping member for securing the adaptor to the medical container, a needle access port adapted to face the outer surface of the septum when the adaptor is coupled to the medical container, and a pierceable elastomeric piece disposed at least partially within the needle access port and having a longitudinal axis L extending through the needle access port. The pierceable elastomeric piece has a recess defining a proximal opening, an outer wall in contact with the needle access port, and a distal surface having a protruding part engageable with the outer surface of the medical container septum. The pierceable elastomeric piece is maintained within the needle access port when a pressure is applied on the outer surface of the septum by the protruding part.

In accordance with yet a further embodiment, an assembly includes an adaptor coupled with a medical container, the medical container includes a collar closed by a septum, the septum having an outer surface directed towards the outside of the medical container. The adaptor includes a gripping member for securing the adaptor to the medical container, a needle access port adapted to face the outer surface of the septum when the adaptor is coupled to the medical container, and a pierceable elastomeric piece disposed at least partially within the needle access port and having a longitudinal axis L extending through the needle access port. The pierceable elastomeric piece has a recess defining a proximal opening, an outer wall in contact with the needle access port, and a distal surface having a protruding part engageable with the outer surface of the medical container septum. The pierceable elastomeric piece is maintained within the needle access port when a pressure is applied on the outer surface of the septum by the protruding part.

BRIEF DESCRIPTION OF THE DRAWINGS

The present invention will now be described in greater detail based on the following description and the appended drawings, in which.

DESCRIPTION OF THE INVENTION

Figure 1A:
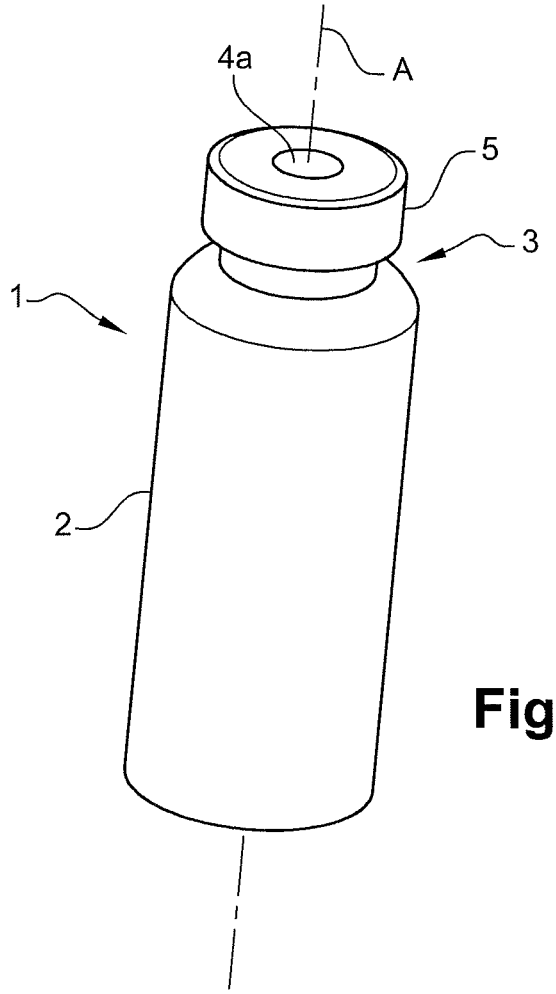
FIG. 1A is a perspective view of a conventional vial on which the adaptor of the invention is mounted.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures.

Figure 1B:
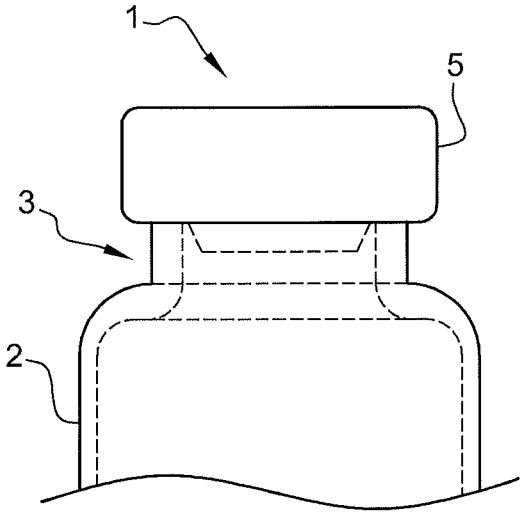
FIG. 1B is a partial side view of the conventional vial of FIG. 1A.
Figure 1C:
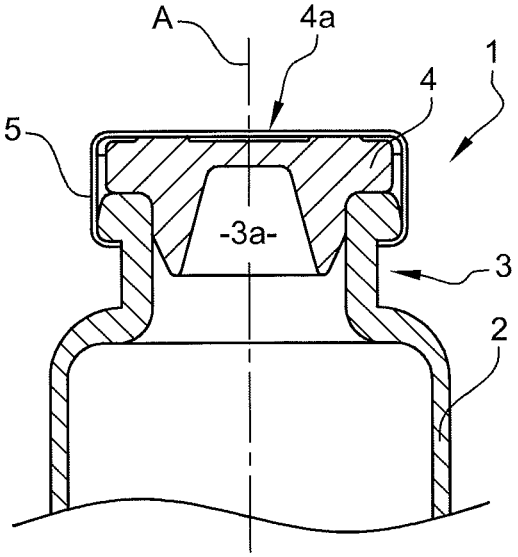
FIG. 1C is a partial cross-sectional view of the conventional vial of FIG. 1A.
Figure 2:
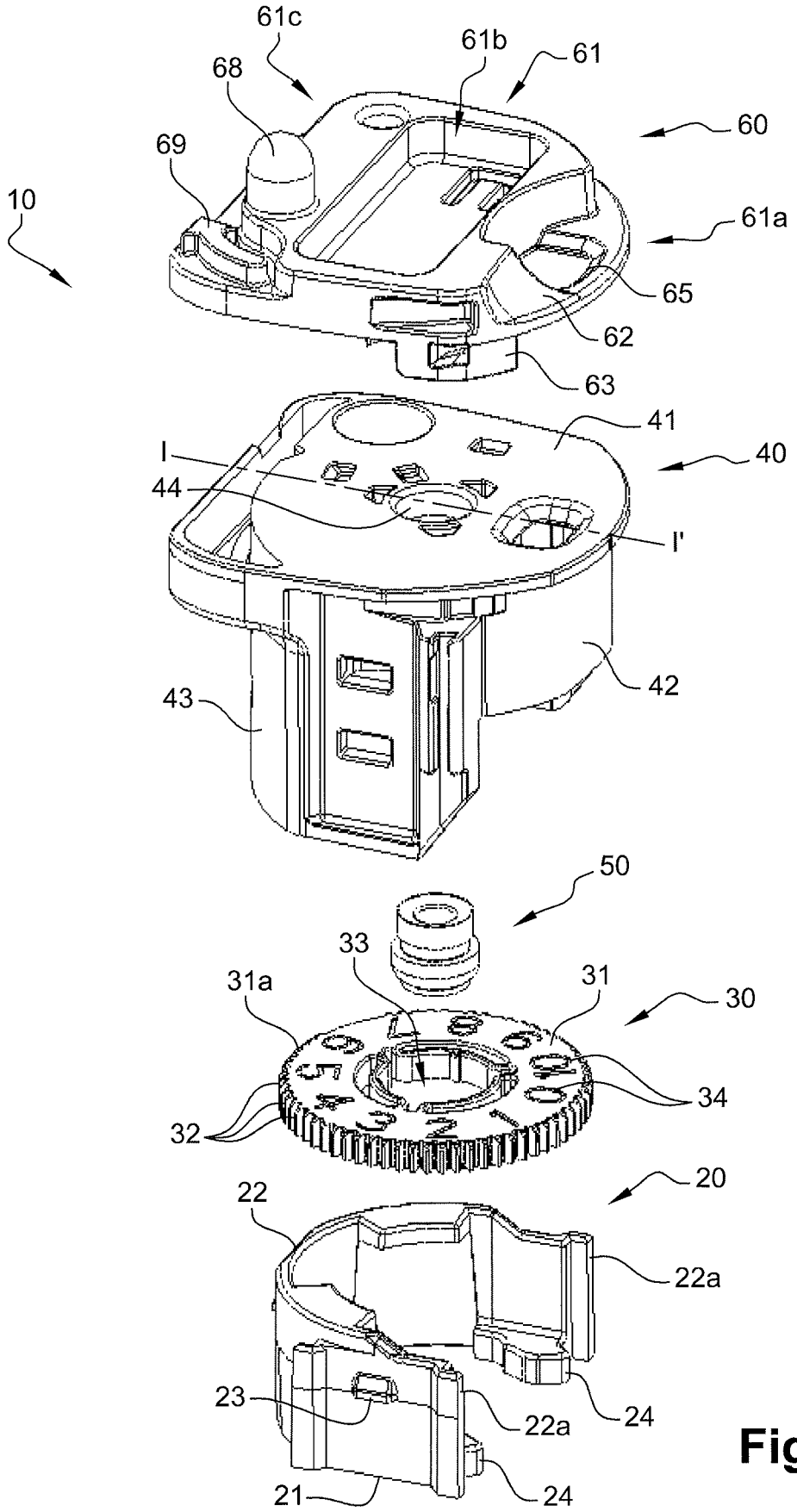
FIG. 2 is an exploded perspective view of an embodiment of the adaptor of the invention.

With reference to FIG. 2 is shown an adaptor 10 in accordance with an embodiment of the invention, intended to be coupled on a multidose vial 1 as shown on FIGS. 1A-1C. The adaptor 10 includes a gripping member 20 intended to secure the adaptor onto the vial 1, a counting ring 30 intended to provide information on the number of doses of product already withdrawn from the vial 1 and/or still left inside the vial 1, a cap 40, intended to be snap-fitted to the gripping member 20, a pierceable elastomeric piece 50 intended to be accommodated in the cap 40, and a cover 60 intended to prevent or allow access to the opening 3*a* of the vial 1, once the adaptor 10 is coupled to the vial 1.

With reference to FIG. 2, the gripping member 20 will now be described in detail. The gripping member 20 includes a U-shaped body 21, having a partially tubular wall 22 with a height suitable for surrounding the collar 3 of the vial 1 (see FIGS. 11A-11B). The gripping member further includes two free ends 22*a* corresponding to the ends of the branches of the U, the U-shaped body 21 therefore forming a clipping member. Close to each free end 22*a*, the tubular wall 22 is provided on its outer surface with radial pegs 23 (only one being visible on FIG. 2). Each free end 22*a* is further provided with a distal front projection forming a radial rim 24.

Still with reference to FIG. 2, the counting ring 30 is made of a flat cylinder 31 provided with a plurality of outer radial teeth 32 distributed along its periphery 31*a*. The flat cylinder 31 is further provided with a central hole 33 dimensioned and shaped so as to fit around radial outer pegs 47 of the cap 40, as shown on FIGS. 4-6. In the example shown on FIGS. 2 to 10, the adaptor 10 is intended to be coupled to a multidose vial 1 filled with ten doses of product. As a consequence, the counting ring 30 is provided with information data corresponding to these ten doses of product to be withdrawn from the vial 1. The flat cylinder 31 is thus provided with printed digits 34 indicating the numbers 1 to 10, these digits being regularly distributed along the circumference of the flat cylinder 31.

Figure 3:
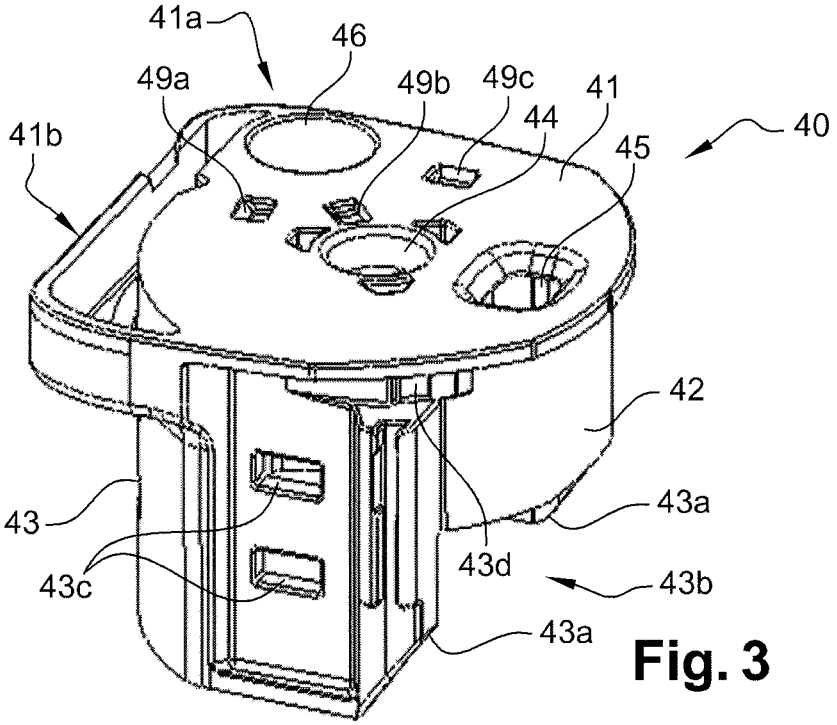
FIG. 3 is a perspective view from the top of the cap of the adaptor of FIG. 2.
Figure 4:
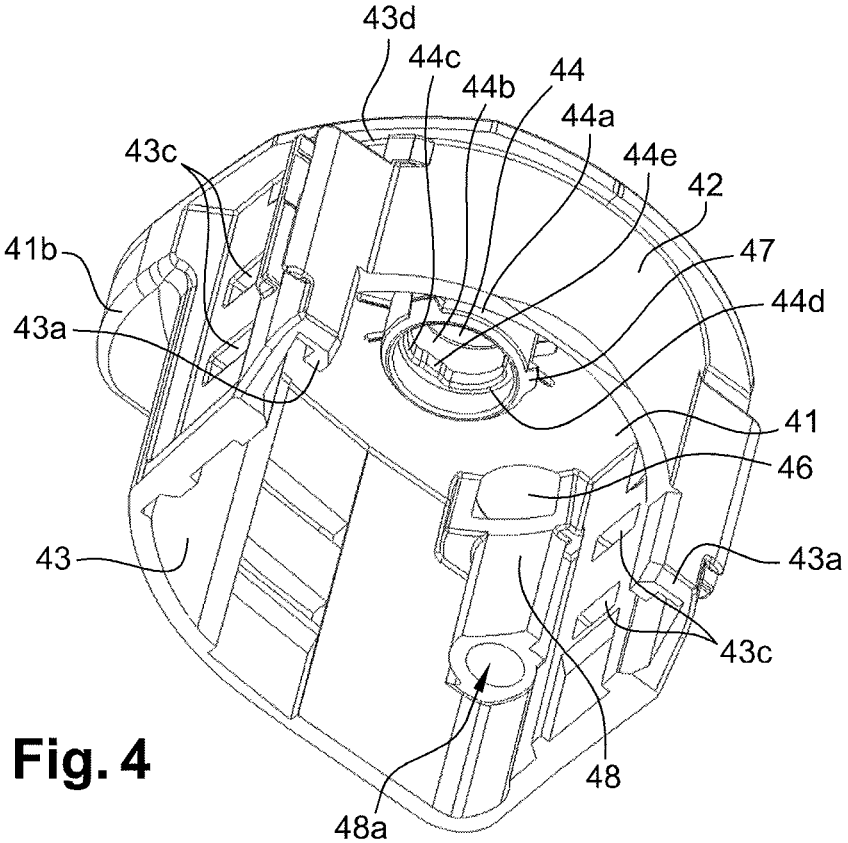
FIG. 4 is a perspective view from the bottom of the cap of the adaptor of FIG. 2.

With reference to FIGS. 3 and 4, the cap 40 will now be described in detail. The cap 40 includes a transversal wall 41 having a substantially circular shape except a corner 41*a*, and a rear extension 41*b*. A front rim 42 is extending from the front of the transversal wall 41 in the distal direction. A U-shaped skirt 43 also extends from the transversal wall 41 in the distal direction, the free ends 43*a* of the U forming a front opening 43*b* of the skirt 43. Close to each free end 43*a*, the skirt 43 is provided on its outer surface with four recesses 43*c* (only two being visible on FIG. 2) and a notch 43*d* immediately nearby the transversal wall 41. The circular transversal wall 41 is provided with a central access port 44 and with a front side hole 45. The transversal wall 41 is further provided in its corner 41*a* with a corner hole 46 surrounded by three openings 49*a*, 49*b* and 49*c* regularly placed around the corner hole. In the present embodiment, the access port 44 is designed to accommodate a needle and is described as a needle access port 44.

Figure 5:
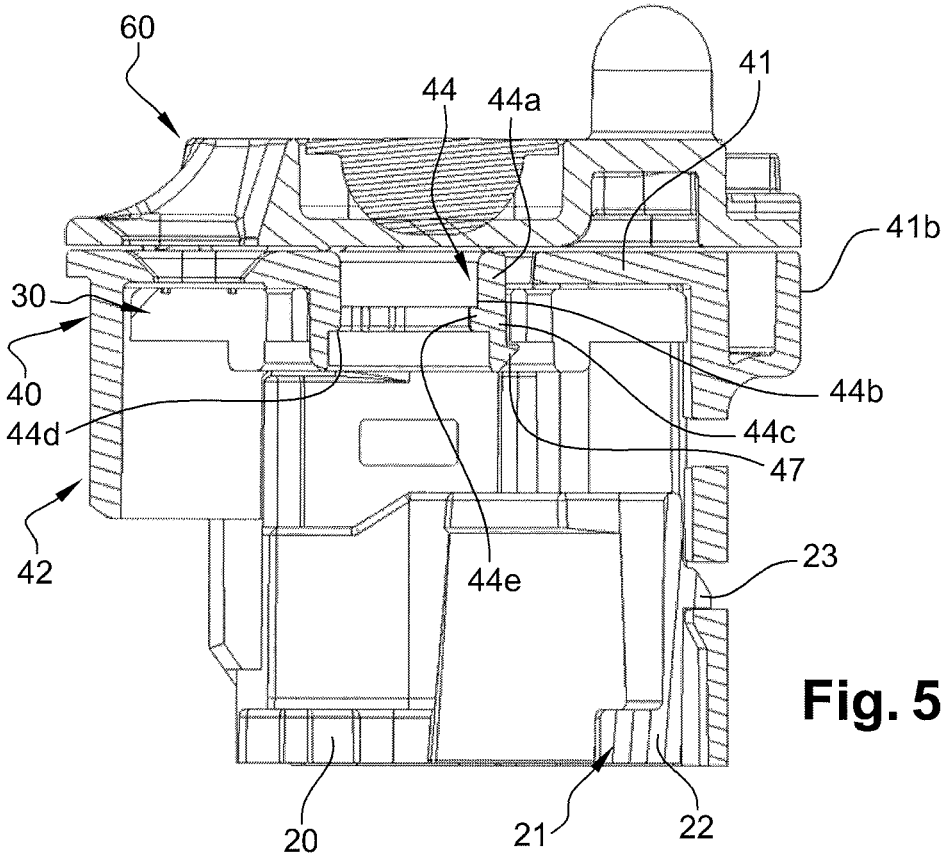
FIG. 5 is a cross-section view of the adaptor of FIG. 2, without a pierceable elastomeric piece.
Figure 6:
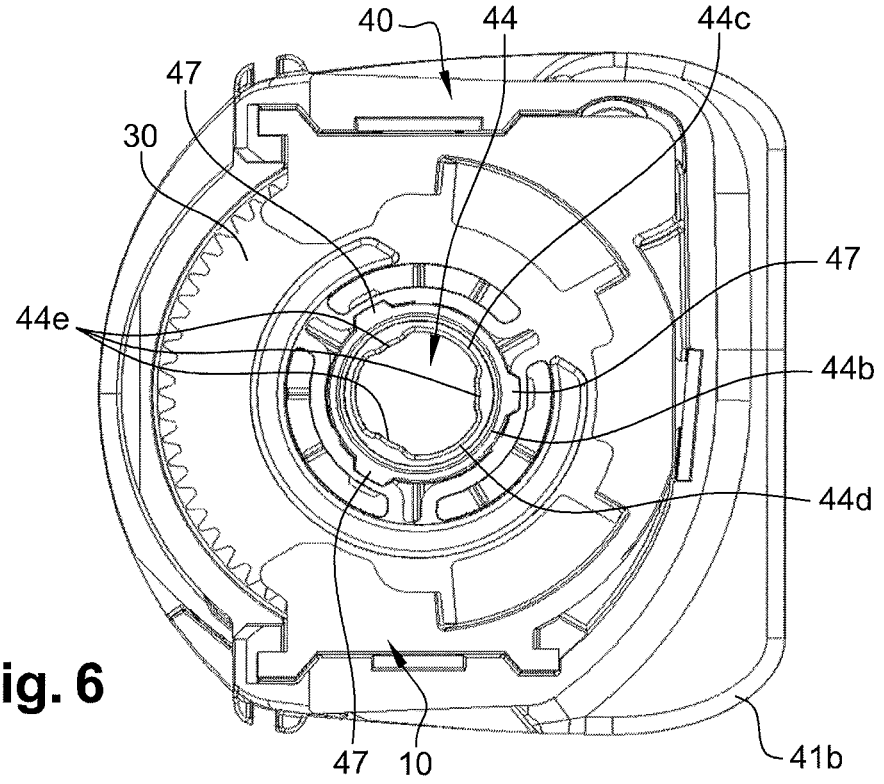
FIG. 6 is a bottom view of the adaptor of FIG. 2, without a pierceable elastomeric piece.

With reference to FIGS. 4 to 6, the proximal face of the transversal wall 41 is provided with three radial outer pegs 47 and the U-shaped skirt 43 is provided on its inner wall with a corner transversal rim 48 having a central hole 48*a* that faces the corner hole 46. The cap 40 is sized and shaped for receiving the counting ring 30 and the gripping member 20. As shown on FIGS. 5 and 6, the counting ring 30 is plugged inside the front rim 42 thanks to the radial outer pegs 47.

Moreover, the U-shaped skirt 43 of the cap 40 is aligned with the U-shaped element 21 of the gripping member 20 when the different elements of the adaptor 10 are assembled. With reference to FIGS. 4 to 6, the needle access port 44 consists in a longitudinal wall 44*a* extending from the distal face of the transversal wall 41 and having an inner surface 44*b*. The inner surface 44*b* includes an inner ring 44*c* having a distal abutment surface 44*d* present on the whole circumference of the longitudinal wall 44*a* as shown on FIG. 6 and defining three inner radial pegs 44*e* extending into the needle access port 44.

With references to FIGS. 7A and 7B, the pierceable elastomeric piece 50 will now be described in detail. The elastomeric piece 50 has globally the shape of a cylinder with a longitudinal axis L and is intended to be accommodated inside the needle access port 44 as shown on FIG. 8. In other embodiments not shown, the elastomeric piece could have globally the shape of a cube, a pyramid or a cylinder with a non-circular base. The pierceable elastomeric piece 50 includes a recess 51 opened in the proximal direction, a proximal surface 52, a distal surface 53 and an outer wall 54. The recess 51 with its proximal opening 51*a* includes an inner longitudinal surface 51*b* and a bottom surface 51*c* provided with a central protrusion 55. The proximal surface 52 of the elastomeric piece 50 is sloped distally toward the center of the recess 50, preferably forming an angle $\alpha$ ranging from 45° to 75° regarding the longitudinal axis L and is linked to the inner longitudinal surface 51*b* by a chamfer 52*a*: a bull nose in the present case. The distal surface 53 defines a protruding part 53*a* that is extending distally. The outer wall 54, which links the distal surface 53 with the proximal surface 52, includes a circular groove 56 defining a proximal shoulder 57, both circular groove and shoulder extending on the whole circumference of the longitudinal wall 54 as shown on FIG. 7B. The circular groove 56 is intended to be engaged with the inner radial pegs 44*e* of the needle access port 44 and the shoulder 57 is intended to contact the abutment surface 44*d* of the needle access port 44 when the pierceable elastomeric piece 50 is assembled in the cap 40 as it can be seen on FIG. 8.

Figure 7A:
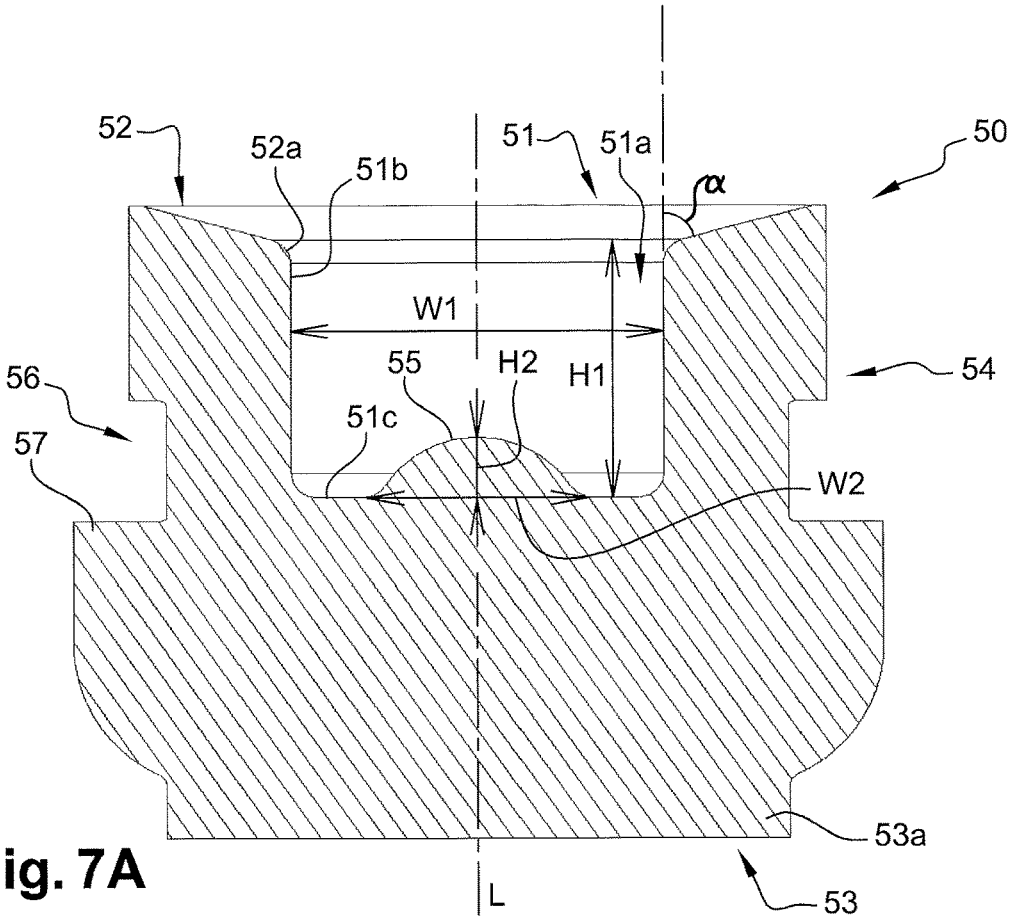
FIG. 7A is a cross-sectional view of the elastomeric piece of the adaptor of FIG. 2.
Figure 7B:
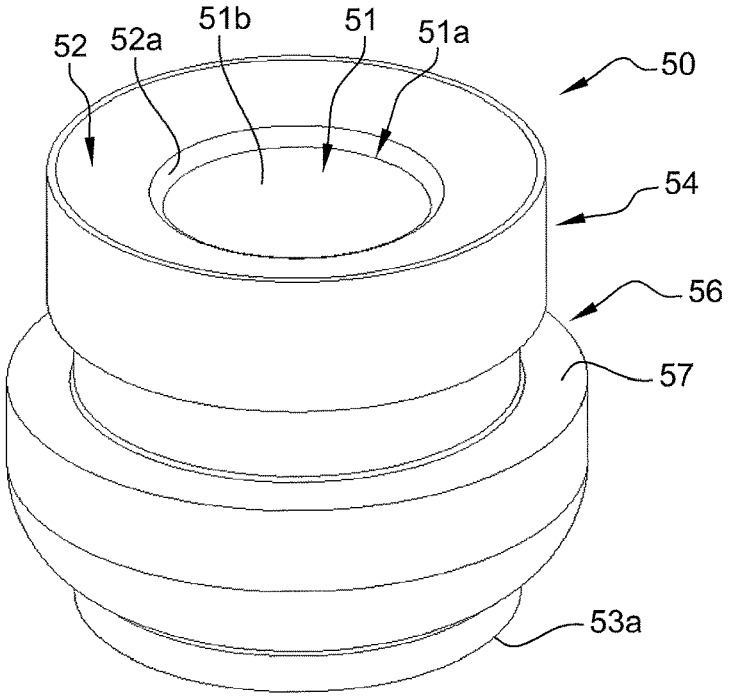
FIG. 7B is a top perspective view from the top of the elastomeric piece of the adaptor of FIG. 2.
Figure 8:
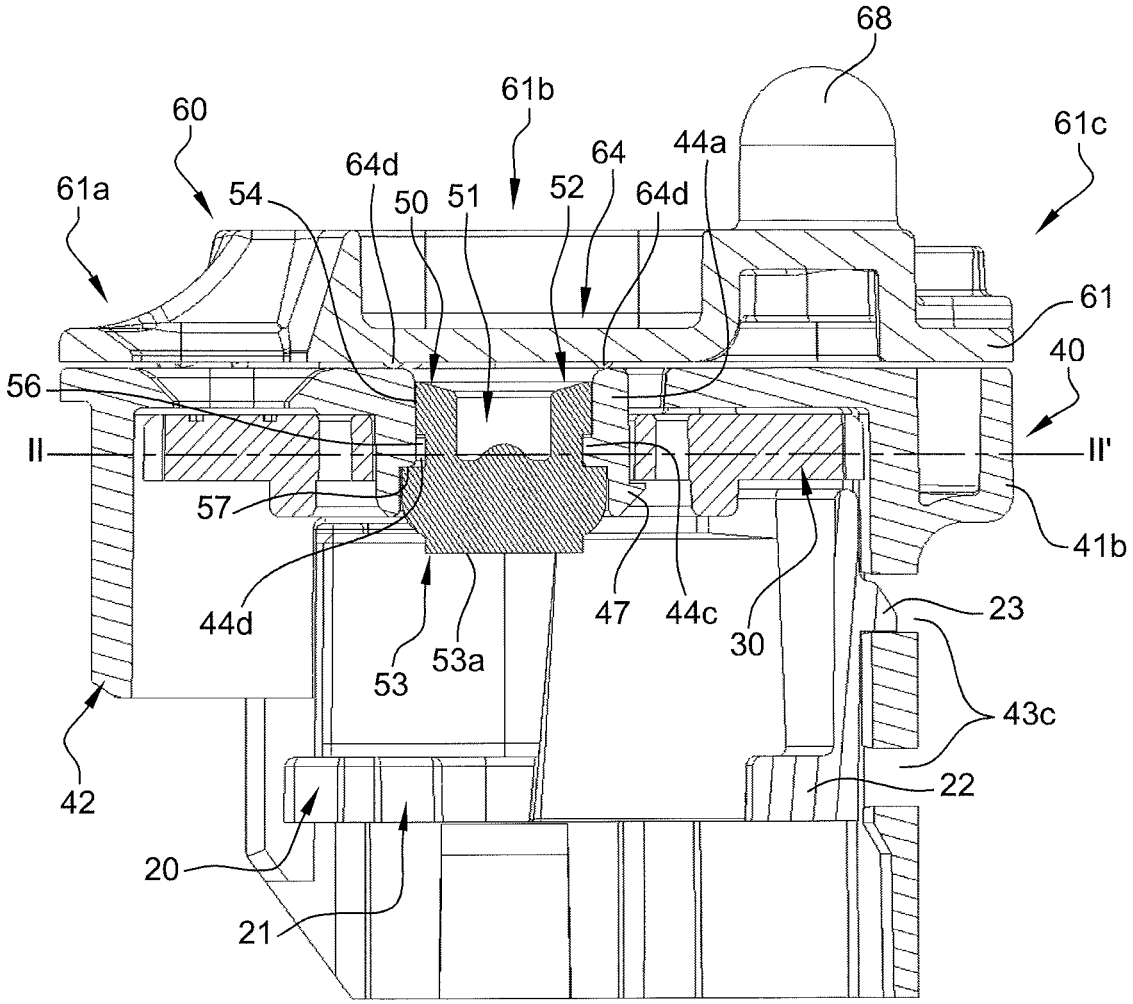
FIG. 8 is a cross-section view of the adaptor of FIG. 2, with a pierceable elastomeric piece.

In the embodiment shown on FIGS. 7A-8, the ratio between the height H2 of the central protrusion 55 of pierceable elastomeric piece 50 regarding the height H1 of the recess 51 is about 0.2 while the ratio between the width W2 of the central protrusion 55 regarding the width W1 of said recess 51 is about 0.6. In the embodiment shown on FIGS. 7A and 7B, the recess 51 has a diameter of 3 mm and a height of 2.4 mm. The distance between the bottom surface 51*c* of the recess 51 and the distal surface 53 of the elastomeric piece is about 2.8 mm. This distance should be adapted to the length of the needle lumen that will pierce the septum in order to prevent ambiant air to be sucked inside the vial 4 when the needle is removed from the pierceable elastomeric piece 50.

As it can be seen on FIG. 8, the height of the pierceable elastomeric part is slightly higher than the height of the needle access port 44 and the protruding part 53*a* of the pierceable elastomeric piece is projected beyond the distal part of the longitudinal wall 44*a* of the needle access port 44. This allows the protruding part 53*a* to contact and deform the outer surface 4*a* of the septum 4 when the adaptor 10 is mounted onto a medical container as it is shown on FIG. 11B. In other words, the outer surface 4*a* of the septum 4 is engaged by the protrusion part 53*a*. In other embodiments not shown, the ratio of the height H1 of the recess 51 regarding its width W1 ranges from 0.3 to 0.7, while the ratio between the height H2 of the central protrusion 55 and the height H1 of the recess ranges from 0.1 to 0.3 and a ratio between the width W2 of the central protrusion and the width W1 of the recess is about 0.3 to 0.7.

Suitable materials for the pierceable elastomeric piece 50 of the adaptor of the invention include natural rubber, acrylate-butadiene rubber, cis-polybutadiene, chlroro or bromobutyl rubber, chlorinated polyethylene elastomers, polyalkylene oxide polymers, ethylene vinyl acetate, fluorosilicone rubbers, hexafluoropropylene-vinylidene fluoride-tetrafluoroethyleneterpolymers, butyl rubbers, polyisobutene, synthetic polyisoprene rubber, silicone rubbers, styrene-butadiene rubbers, tetrafluoroethylene propylene copolymers, thermoplastic-copolyesters, thermo-plastic elastomers, or the like or a combination thereof.

Preferably, the elastomeric piece is self-resealing and it automatically and rapidly closes the hole produced by the piercing of the needle, for example in less than 0.5 seconds, once the needle is removed from the elastomeric piece. This automatic closure step may occur a high number of times, in particular as many times as necessary for removing the number N doses of product initially present in the multidose vial 1. Suitable materials for self-resealing pierceable elastomeric piece include synthetic polyisoprene, natural rubber, silicone rubber, thermo-plastic elastomers, or the like or a combination thereof.

The cover 60 will now be described in detail with reference to FIGS. 2, 8, 9A and 9B. The cover 60 includes a sheet 61 having substantially the shape of the transversal wall 41 of the cap 40, with a front portion 61*a*, a central portion 61*b*, a rear portion 61*c* and a corner 61*d* on a side of the rear portion 61*c*. When the cover 60 is mounted onto the cap 40 in a closed position (FIGS. 8 and 9A), the front portion 61*a* is intended to be aligned with the front rim 42, the central portion 61*b* is intended to cover the needle access port 44 and the rear portion is intended to cover the rear extension 41*b*. Considering the proximal face of the sheet 61 shown on FIGS. 2 and 9A, the front portion 61*a* of the cover 60 comprises a front hole 65 intended to face the front side hole 45 of the transversal wall 41 of the cap 40 as well as a pushing surface 62 located on a side of the front portion 61*a* intended to be in contact with the thumb of a user when the adaptor 10 is in a used-position, as it will be described below with reference to FIG. 12A. In the present embodiment, this pushing surface is substantially curved and turned toward the proximal direction and the front portion of the cover 60. The central portion 61*b* consists in a planar portion 64 defining a space for writing data or sticking a label. On the same side than the pushing surface 62, the rear portion 61*c* of the sheet 61 is provided with a guiding member 68, for example a stud extending proximally and an optional arrow 69 that can be present for indicating the direction of the rotation of the cover 60 when the adaptor 10 is in a used-position. In the present case, the arrow indicates the clockwise direction.

In this preferred embodiment, both the guiding member 68 and the pushing surface 62 must be significantly offset to the corner 61*d*. Preferably, the pushing surface 62 is located as far as possible from the corner 61*d*, while the guiding member 68 could be located slightly closer to that corner i.e. not at the extremity of the sheet 61. For example, the ratio between the distance of the corner 61*d* to the guiding member 68 and the distance of the corner 61*d* to the center C of the sheet 61 may range from 1.5 to 0.75.

More precisely, as the cover 60 is considered to have a substantially circular shape defining a center C located on the planar portion 64, therefore the pushing surface 62 is localized at about 180° from the corner 61*d*, while the guiding member 68 is placed approximately at 270° clockwise. The front hole 65 is located approximately at 135° clockwise from the corner 61*d*, but any other convenient area of the cover 60 could be also considered.

In other embodiments not shown, the guiding member could have another form such as a hole, a lug or a ring and the distal surface bulges from the sheet 61.

Figure 9A:
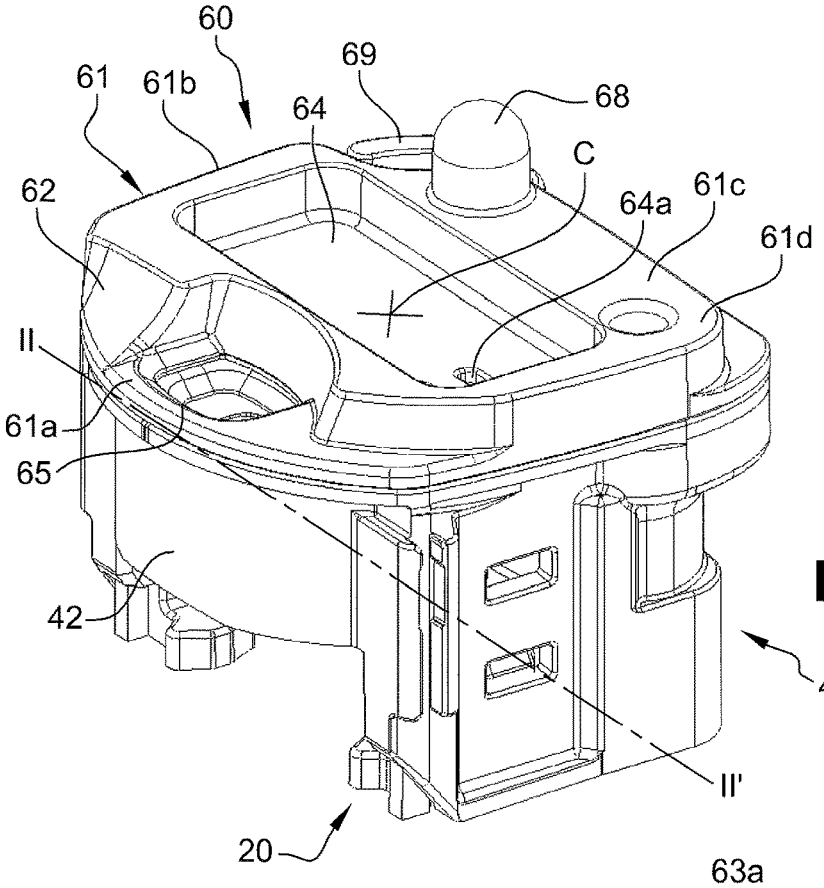
FIG. 9A is a perspective view from the top of a cover assembled on the adaptor of FIG. 2.
Figure 9B:
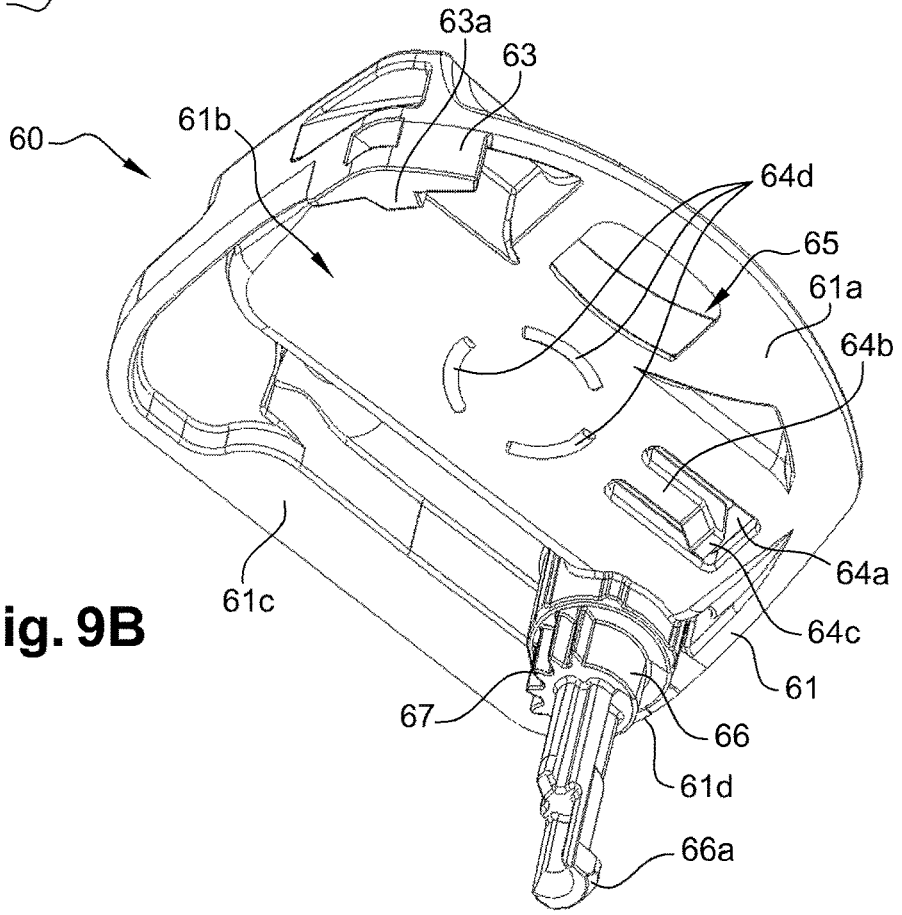
FIG. 9B is a perspective view from the bottom of a cover not assembled on the adaptor of FIG. 2.
Figure 10:
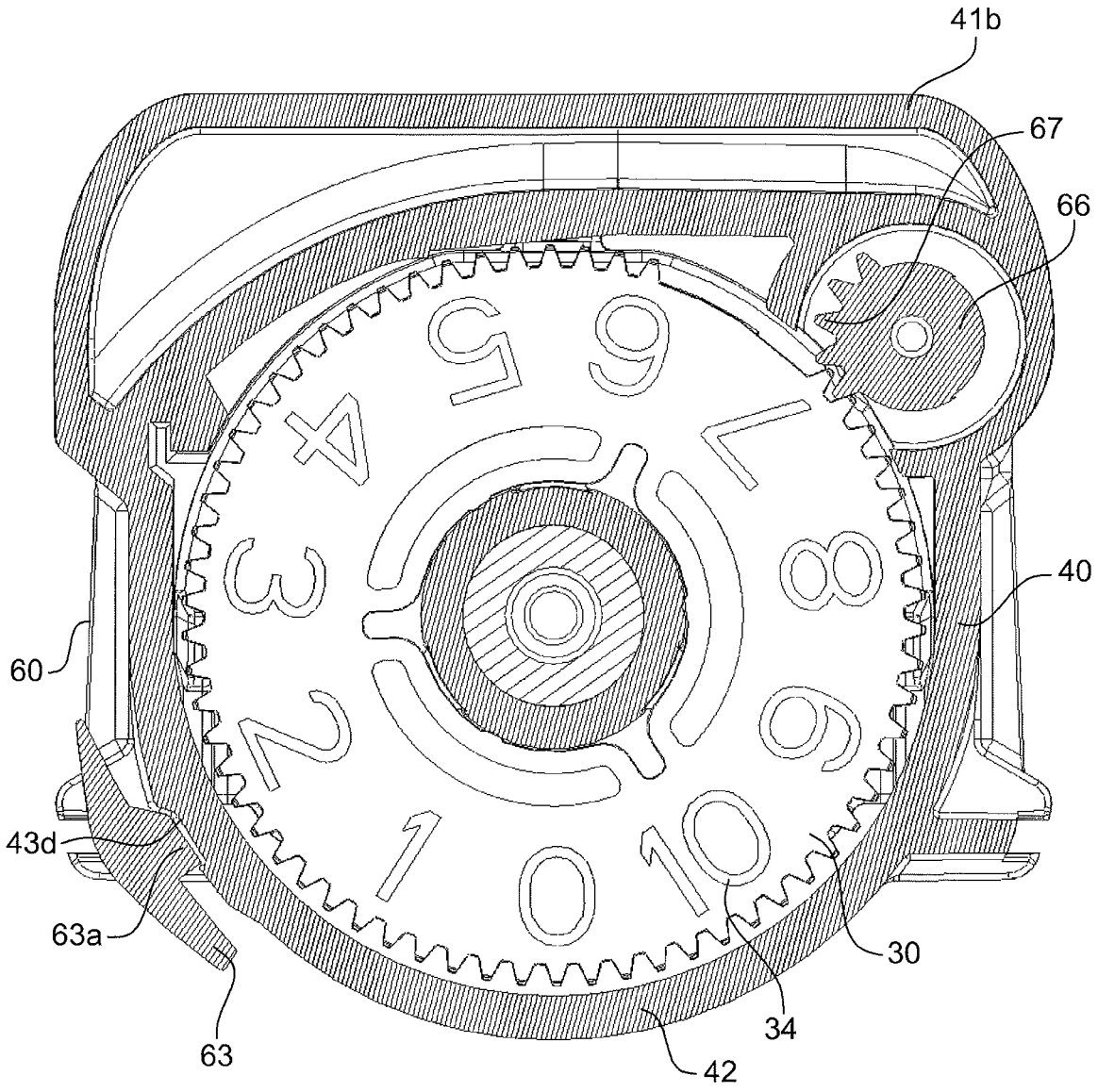
FIG. 10 is a cross-section view of an adaptor of FIG. 9A along line II-II'.

Now considering the distal face of the sheet 61 as shown on FIG. 9B, the front portion 61*a* includes a longitudinal extension 63 directed in the distal direction and provided with a radial peg 63*a* (FIGS. 2 and 9B). When the cover 60 is assembled onto the cap 40 in a closed position, the peg 63*a* of the extension 63 is engaged with the notch 43*d* of the U-shaped skirt 43, as it can be seen on FIG. 10, thereby forming locking means.

Furthermore, as shown on FIGS. 9A and 9B, the planar portion 64 is provided with a window 64*a* having a flexible leg 64*b* substantially parallel to the sheet 61 and including a distal tooth 64*c*. The distal tooth 64*c* includes a straight surface and a sloped surface. When the cover 60 is assembled with the cap 40 in a closed position, the distal tooth 64*c* is capable to cooperate with the openings 49*a*, 49*b* and 49*c* as will be explained below. On the distal face of the planar portion, a discontinuous circular rim 64*d* including three segments is intended to face the needle access port 44 of the cap 40 as well as the proximal opening 51*a* of the pierceable elastomeric piece 60, when the cover is assembled on the adaptor 10 and in a closed position. More generally the discontinuous circular rim 64*d* can include at least one discontinuous segment. The corner 61*d* of the sheet 61 is provided with a shaft 66 extending in the distal direction having a distal outer rim 66*a* at its extremity, as shown on FIG. 9B. Additionally, a semi-gear wheel 67 is present on the shaft 66. The semi-gear 67 is proximally spaced from the distal outer rim 66*a* and has outer radial teeth only on a part of its circumference.

The sheet 61 may be made of any material such as high-density polyethylene, polypropylene, polyvinyl chloride, acrylonitrile-butadiene-styrene (ABS), silicon resin or any other rigid polymer. Alternatively, materials such as metal, wood or glass may be used.

The use of an adaptor 10 once connected with a vial of FIGS. 1A-1C will now be explained with reference to FIGS. 11A to 12C.

Figure 11A:
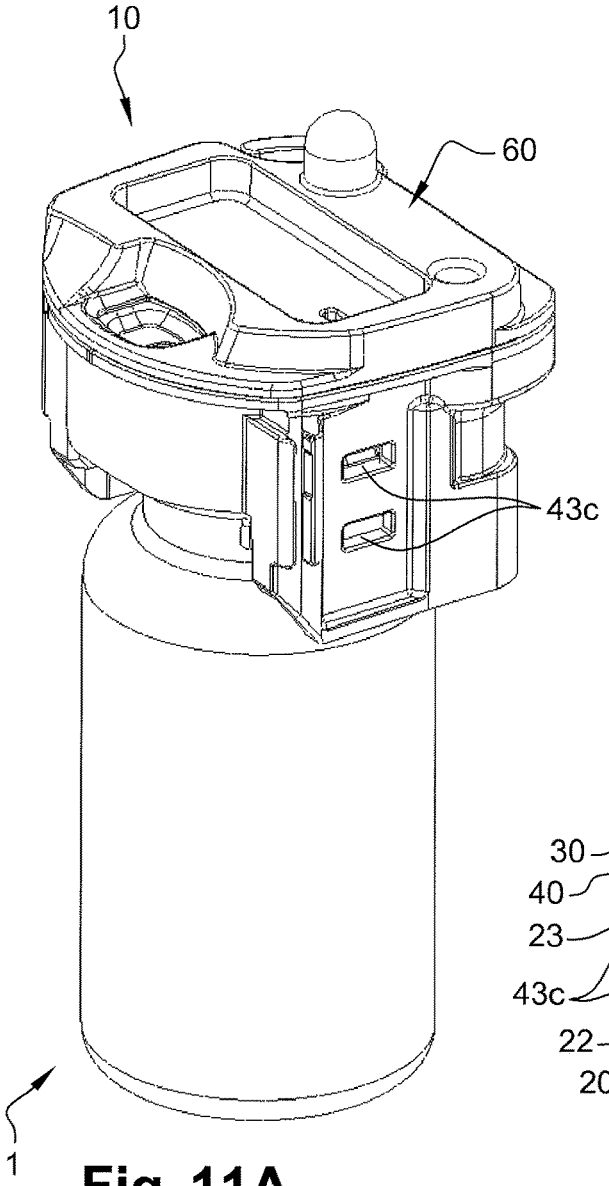
FIG. 11A is a perspective view of the adaptor of FIG. 2 coupled with a vial.
Figure 11B:
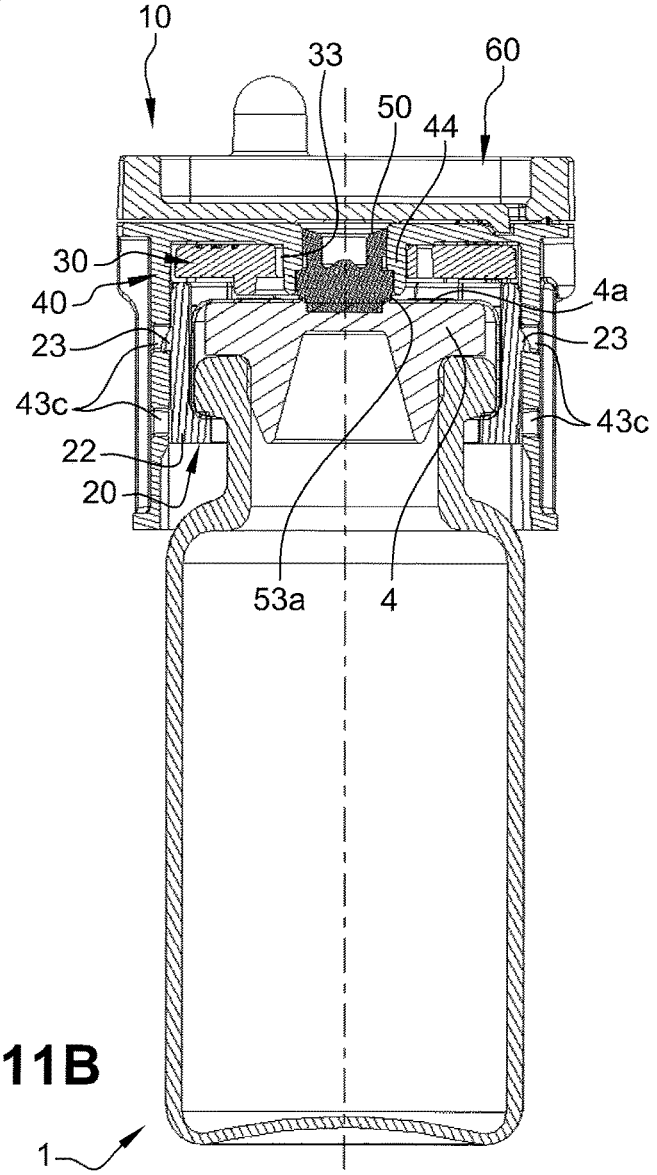
FIG. 11B is a cross sectional view of the adaptor of FIG. 2 coupled with a vial.

With reference to FIGS. 11A and 11B, the adaptor 10 is shown once coupled to a vial 1 and closed by the cover 60. In this view, the gripping member 20 has been mounted on the collar 3 of the vial and the radial rims 24 now surround the collar 3, thereby securing the adaptor 10 on the vial 1. In this coupled position of the adaptor 10 on the vial 1, the needle access port 44, in which is lodged the pierceable elastomeric piece 60, is aligned with the septum 4 and with the opening 3*a* of the vial 1.

The pierceable elastomeric piece 50 extends through the central hole 33 of the counting ring 30 to come in close contact with the outer surface 4*a* of the septum 4 of the vial 1. In particular, the protruding part 53*a* even distorts the outer surface 4*a* of the septum 4, as can be seen on FIG. 11B. The pierceable elastomeric piece 50 is maintained in the needle access port 44 by the engagement of the inner radial pegs 44*e* of the needle access port in its circular groove 56. Moreover, a distal pressure is applied by the protruding part 53*a* on the outer surface 4*a* of the septum 4. This contact pressure has to be maintained as long as doses remain into the vial, to prevent any contamination of the inside of the vial by the ambient air. Any proximal translation of the pierceable elastomeric piece 50 regarding the cap 40, resulting from this contact pressure, is prevented as the shoulder 57 is resting on the abutment surface 44*d* of the needle access port 44. Furthermore, the design of the shoulder 57 in the needle access port 44 prevents any deformation of these rigid plastic parts overtime, which is particularly valuable when doses are withdrawn from the vial over a period of several weeks. The inner radial pegs 44*e* together with the circular groove 56, and the abutment surface 44*d* together with the shoulder 57 therefore form attaching means for maintaining the elastomeric piece 50 into the needle access port 44 despite the contact pressure with the septum 4*a* of the vial 1. Thanks to these attaching means, the elastomeric piece 50 can efficiently prevent dust and microorganisms to contaminate the pharmaceutical product stored into the vial 1.

In addition to appropriately connecting the elastomeric piece 50, the attaching means 44*e*, 56, 57 and 44*d* also allow a fast and straightforward assembly of the elastomeric piece 50 inside the needle access port 44. Indeed, the elastomeric piece 50 can be presented by the distal face of the cap 40, proximally pushed into the needle access port 44. It is easily deformed in the needle access port thanks to its elastomeric properties which allow the inner radial pegs 44*e* to pass along the distal portion of the longitudinal wall 54 up to the circular groove 56. The shoulder 57 rests on the abutment surface 44*d* of the needle access port 44 and prevents any further proximal translation: the elastomeric piece 50 is correctly assembled with the cap 40. This straightforward assembly is particularly valuable for a fast and cost-efficient manufacturing of the present adaptor.

With reference to FIGS. 8, 11A and 11B, the flat cylinder 31 of the counting ring is snap-fitted on the cap 40 and the central hole 33 is engaged with the radial outer pegs 47 of the cap 40, in order to block the flat cylinder 31 in the distal direction. Therefore, the flat cylinder 31 is capable of rotating with respect to said radial outer pegs 47.

Additionally, the cap 40 is itself snap-fitted on the gripping member 20 thanks to the recesses 43*c* engaged with the radial pegs 23 present on the tubular wall 22 of U-shaped element 21 of the gripping member 20. As a consequence, the cap 40 is fixed with respect to the gripping member 20. In an embodiment not shown, the cap 40 and the U-shaped element 21 can be integrated together and form a single element, namely the gripping member.

According to the FIGS. 11A and 11B, the cover 60 is linked to the cap 40 as the shaft 66 is plugged into the corner hole 46 of the transversal wall 41 and snap-fitted into the corner transversal rim 48 as can be seen on FIGS. 4 and 9B. The shaft 66 can rotate within corner hole 46, in a clockwise direction indicated by the arrow 69. The shaft 66 together with the corner hole 46 therefore form a hinge at the corners 41*a* and 61*d* of the cap 40 and the cover 60, respectively. This hinge (46, 66) allows the planar rotation of the cover 60 from a first position closing the needle access port 44 to a second position giving access to the needle access port 44. For a straightforward and efficient rotation, this hinge is located on a side of the cover 60. More precisely, in the present embodiment, the hinge (46, 66) is located on the rear portion of the cover 60, i.e. on the corner 61*d*. The cover 60, the cap 40 and the hinge (46, 66) therefore form a closing system for the vial 1.

The cover 60 is maintained in its first, closed position as the peg 63*a* engages the notch 63*d* of the cap 40, the peg 63*a* and the notch 43*d* serving as locking means for preventing any undesired rotation of the cover 60. The cover 60 therefore allows an efficient protection against dust and contamination of the elastomeric piece 50 and thus of the septum 4 of the vial 1, when the vial 1 is not in used.

Usually the vials containing vaccines are stored at cold temperature (2-8° C.) and, when a user takes a vial out of the refrigerated storage, some condensation could appear on the surface of the vial septum and/or on the surface of adaptor 10 as it is exposed to ambient temperature. The discontinuous circular rim 64*d* of the cover 60 is in tight contact with the transversal wall 41 of the cap 40, in particular with the portion located around the needle access port 44, when the cover 60 is in its closed position. This prevents any condensation from being trapped into the recess 51 while effectively closing the needle access port 44 as this discontinuous circular rim 64*d* allows a gas exchange between the recess 51 and the outside environment.

Furthermore, the distally sloped surface 52 of the elastomeric piece 50 shown on FIGS. 7A and 7B is also designed to guide the condensation towards the recess 51 therefore limiting the trapping of the condensation between the elastomeric piece 50 and the needle access port 44. The growth of bacteria around the elastomeric piece 50 is therefore widely prevented, as this space is kept dry from condensation. The condensation is not trapped but directed towards the recess 51 where it can be evaporated, even when the cover 60 is closed thanks to the discontinuous rim 64*d*.

Thanks to its configuration, the protrusion 55 of the recess 51 remains a dry and clean pierceable surface as the limited amount of condensation is restricted to a portion of the bottom surface around the protrusion 55. The discontinuous circular rim 64*d*, the distally sloped surface 52 and the protrusion 55 are thus all designed in such a way to prevent or to limit contamination due to bacteria growing in condensation nearby the pierceable elastomeric piece 50 and the septum 4.

Figure 12A:
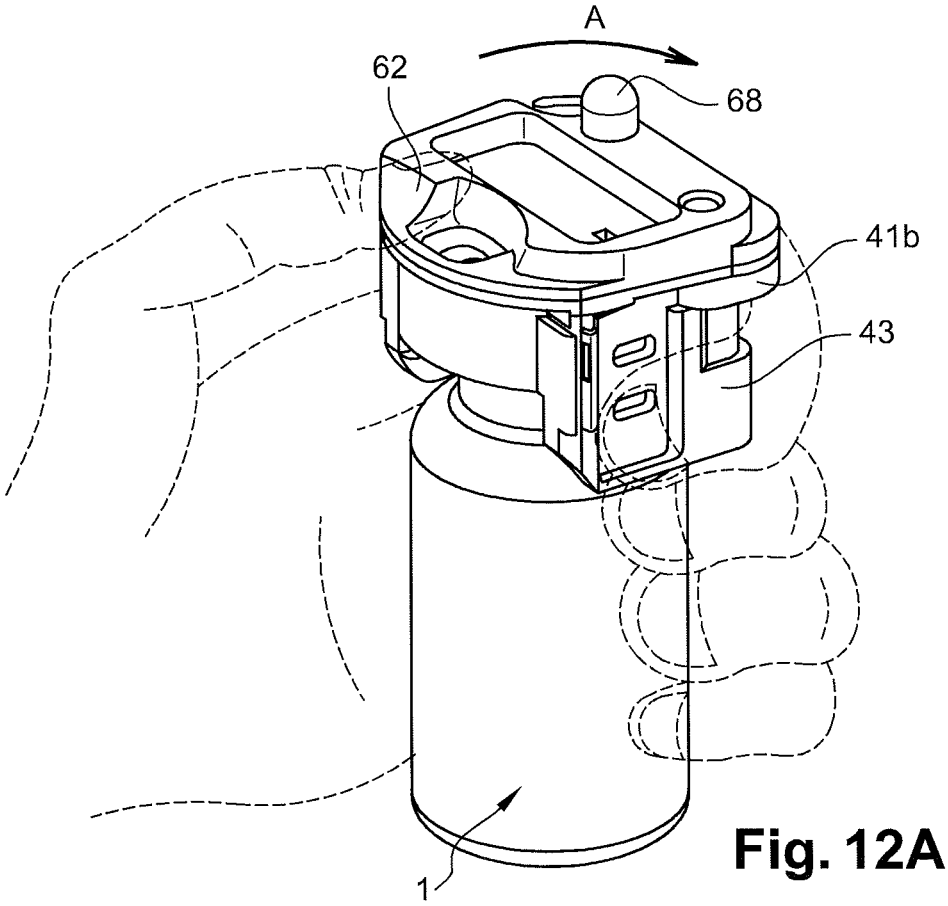
FIG. 12A is a perspective view of the adaptor of FIG. 2 coupled with a vial when opened by a user.
Figure 12C:
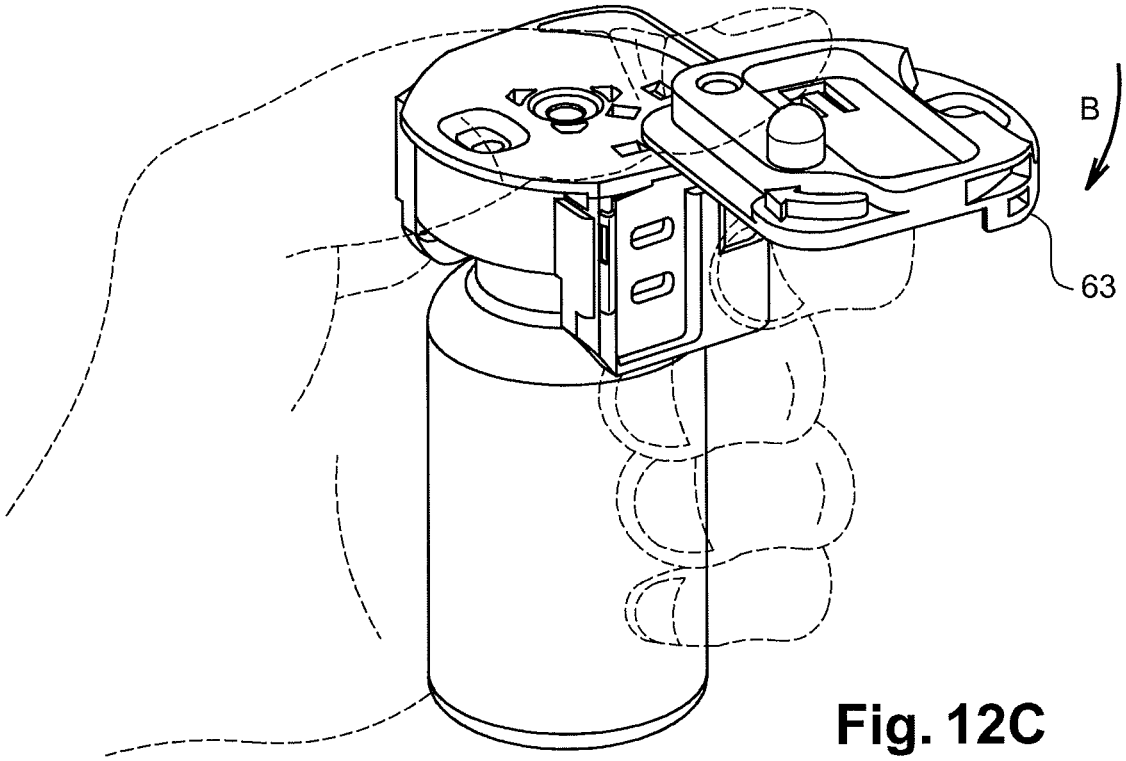
FIG. 12C is a perspective view of the adaptor of FIG. 2 coupled with a vial when closed by a user.
Figure 12B:
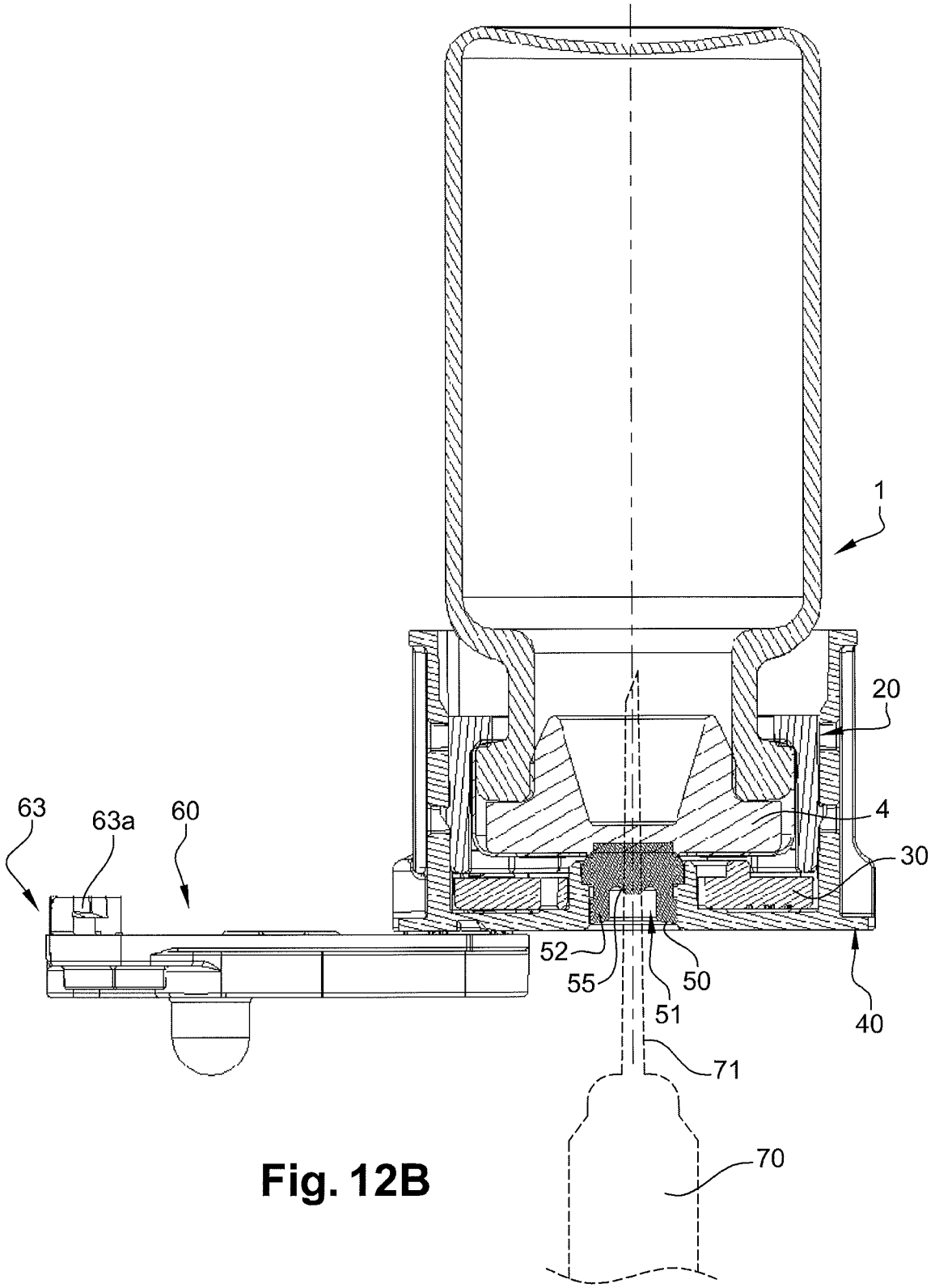
FIG. 12B is a cross-section view of the adaptor of FIG. 2 coupled with a vial when a user withdraws a dose from the vial.

When the user needs to withdraw a first dose of product, he grasps the adaptor 10 coupled to the vial 1, his index finger contacting the U-shaped skirt 43 and the rear extension 41*b* of the cap 40 as can be seen on FIG. 12A. The thumb is placed on the pushing surface 62 of the cover 60, while the other fingers are gripping the vial 1. To move the cover 60 from its first closed position to a second open-position, the user just pushes the pushing surface with his thumb in direction A, therefore disengaging the peg 63*a* of the cover 60 from the notch 43*d* of the cap 40 as shown on FIG. 10. This movement leads to a planar, clockwise rotation of the cover 60 above the cap 40. During this rotation, the distal tooth 64*c* of the cover 60 is engaged successively with the opening 49*a*, 49*b*, and 49*c* of the cap 40 as this tooth 64*c* has a sloped surface inclined toward the direction of the rotation as seen on FIG. 9B. Thanks to its straight surface in the counter direction of the rotation, the flexible leg 64*b* and the distal tooth 64*c* prevent the cover 60 from moving in the counterclockwise direction, and therefore form, together with the openings 49*a*, 49*b* and 49*c* unidirectional means. These unidirectional means help and guide the user to operate the adaptor 10 in a safe and appropriate manner, even if he does not have received any particular training.

To complete the movement of the cover 60 to its second, open position, the user sustains the pressure on the pushing surface 62 until the cover 60 is at 180° of its first position and allows the access to the needle access port 44.

Then the user can withdraw a dose of the pharmaceutical product stored in the vial 1. This can be done by turning the vial over, the proximal face of the transversal wall 41 now substantially facing the ground as shown on FIG. 12B. The user then pierces both the elastomeric piece 50 and the septum 4 of the vial 1 with the needle 71 of an injection device 70. Thanks to the proximal surface 52 of the elastomeric piece 50, sloped distally towards the center of the recess 51, the needle 71 is guided into the recess 51 to pierce directly the central protrusion 55. Thanks to the appropriate inclination of the sloped proximal surface 52, the risk of accidental pricking of the user by ripping of the needle on the needle access port is significantly reduced. When the needle 71 pierces the elastomeric piece 50 and the septum 4, it directly penetrates the dry and clean protrusion 55, and is not contaminated by any dust or bacteria developing in condensation water.

The user can then fill the injection device 70 by withdrawing a dose of the pharmaceutical product contained in the vial. Even if the inside of the vial 1 is under vacuum after removal of the needle 71, no outside air is sucked inside. Indeed the distal surface 53 of the elastomeric piece 50 and in particular the protruding part 53*a* engages the surface 4*a* of the septum 4. The interface between the elastomeric piece 50 and the septum 4 is preserved from outside air, condensation and contaminants; the elastomeric piece 50 and the septum 4 of the vial 1 behave as a single piece. The elastomeric piece 50 therefore allows the septum 4 of the vial to reseal before the complete removal of the needle 71 and prevents sucking of the outside air into the vial.

With the cover 60 in an open position, the elastomeric piece is directly exposed to outside contaminants. Nonetheless, any direct contact is avoided with the bottom surface of the elastomeric piece, intended to be pierced, even if the user's fingers or any contaminated surface might come in contact with the pierceable elastomeric piece 50. The recess 51 and the proximal surface 52 prevent the user's finger or any other contaminated surface to contact the bottom surface 53. Moreover, if any dust would penetrate the recess or if any condensation would form, they will mainly be restricted around the protrusion 55, therefore keeping the protrusion 55, intended to be pierced, substantially away from contaminants. The recess 51 therefore provides an additional and valuable protection against the contamination of the inside of the vial 1. This is particularly important when the adaptor 10 is used in locations where the user has a limited access to efficient soap or sterilizing solution.

After the injection device 70 is filled with the pharmaceutical product, the adaptor 10 can be closed. Performing this step implies moving the cover 60 from the second open position back to its first closed position. The pushing surface 62 of the cover is now in the opposite direction as regards of the thumb of the user who has to pull on the stud 68 with his thumb for moving the cover 60 in a planar clockwise movement towards its closed position. In this position, the peg 63*a* of the cover 60 is re-engaged in the notch 43*d* of the cap 40 and the cover 60 is locked.

The position of the pushing surface 62 on an opposite side from the hinge (46, 66) and preferably as far as possible, allows a leverage effect resulting in very smooth and easy movement of the cover 60 at the beginning of its rotation. The position of the guiding member 68, offset from the corner 61*d* but not at the extremity of the sheet 61, allows closing the cover 60 with a limited movement of the user's thumb.

The pushing surface 62 and the stud 68 therefore permit a relay as an interface for the user's thumb. The pushing surface 62 allows the user to rotate the cover 60 for the first 180° (the opening), while the stud 68 allows the user to rotate the cover 60 for the last 180° (the closing). The pushing surface can also help the user for the very last degrees of the rotation, as it is almost came back to its first position in front of the thumb. The stud 68 can also be used during the opening, for example if the user is unable to grasp the vial 1 in an appropriate way. These two interfaces, namely the pushing surface 62 and the guiding member 68 therefore allow a straightforward and reliable operation of the cover 60.

During the whole operation, only a single hand is required to open and close the cover 60 of the adaptor 10. Thanks to the hinge formed by the shaft 66 coupled with the corner hole 46 of the cap 40, the pushing surface 62 and the stud 68, the cover 60 can be moved with a single thumb, the other fingers grasping both the vial and the adaptor. As a result, the user can grasp with its second hand any other required material, such as an injection device.

Moreover, the clockwise rotation indicated by the arrow 69 present on the cap is forced by the unidirectional means 64*b*, 64*c*, 49*a*, 49*b* and 49*c*. Additionally, the fingers of user are just in contact with the cover 60 and with the rear extension 41*b* of the cap 40 and do not contact neither the cap 40 nor the elastomeric piece 50. This leads to a safe and straightforward operation with limited contamination, as the user is prevented from touching the pierceable elastomeric piece 50. The user is therefore preserved from any accidental pricking or movement and does not require particular training to properly operate the adaptor 10.

Indeed, the closing system including the transversal wall 41 and the cover 61 and the hinge (46, 66) could be used with any container intended to be manipulated with a single hand, particularly in the medical area but also in the fields of cosmetics, food or industry. The system according to the present embodiment is included on an adaptor mounted on a container, but could be directly integrated on the container, therefore providing a container "ready-to-use" without the mounting step.

The adaptor 10 of the present invention allows maintaining the sterility and the efficacy of pharmaceutical products when it is coupled to a medical container. It is also safe and straightforward to operate even by a non-trained user.

The invention claimed is:

1. An adaptor for coupling with a medical container, said medical container having a collar closed by a septum, said septum having an outer surface directed towards the outside of the medical container, the adaptor comprising:

a gripping member for securing the adaptor to the medical container, a needle access port facing the outer surface of the septum when the adaptor is coupled to the medical container, and a pierceable elastomeric piece having a longitudinal axis located into the needle access port, said pierceable elastomeric piece having a recess with a proximal opening, an outer wall in contact with the needle access port, and a distal surface comprising a protruding part engageable with the outer surface of the medical container septum, wherein the elastomeric piece and the needle access port comprise an attaching arrangement for maintaining the elastomeric piece into said needle access port when a pressure is applied by the protruding part on the outer surface of the septum, wherein a circumferential groove is defined in an outer circumferential side surface of the pierceable elastomeric piece that receives the attaching arrangement to maintain the elastomeric piece into said needle access port, and wherein the outer circumferential side surface of the pierceable elastomeric piece extends substantially parallel with a longitudinal axis of the adaptor.

2. The adaptor according to claim 1, wherein said recess comprises a bottom surface defining a central protrusion.

3. The adaptor according to claim 2, wherein a ratio between a height of said central protrusion and the height of said recess ranges from 0.1 to 0.3 and a ratio between a width of said central protrusion and the width of said recess ranges from 0.3 to 0.7.

4. The adaptor according to claim 1, wherein the elastomeric piece has a proximal surface sloped distally to a center of said recess.

5. The adaptor according to claim 4, wherein a slope of the proximal surface of said elastomeric piece forms an angle ranging from 45° to 75° relative to said longitudinal axis.

6. A method of using an adaptor according to claim 1 to prevent the contamination of the inside of a medical container closed by a septum, the method comprising:

providing said medical container having a collar closed by said septum;

providing the adaptor according to claim 1; and attaching said adaptor to said medical container.

7. The adaptor according to claim 1, wherein a ratio between a height of said recess and a width of said recess is 0.3 to 0.7.

* * * * *